US006772972B1

(12) United States Patent
Haselwander

(10) Patent No.: US 6,772,972 B1
(45) Date of Patent: Aug. 10, 2004

(54) CONE HOLDER WITH TUBE END PROTECTORS

(75) Inventor: John Haselwander, Chattanooga, TN (US)

(73) Assignee: Manufacturing Designs & Solutions, Chattanooga, TN (US)

( * ) Notice: Subject to any disclaimer, the term of this patent is extended or adjusted under 35 U.S.C. 154(b) by 0 days.

(21) Appl. No.: 10/193,450

(22) Filed: Jul. 11, 2002

(51) Int. Cl.[7] ..... B65H 19/00

(52) U.S. Cl. ..... 242/128; 242/131.1; 242/571.4; 242/597.3

(58) Field of Search ..... 242/131, 131.1, 242/128, 571.4, 577.1, 597.3, 593

(56) References Cited

U.S. PATENT DOCUMENTS 1,825,822 A * 10/1931 Rundell ..... 242/597.3
2,171,648 A * 9/1939 Ennis et al. ..... 242/597.3
2,898,137 A * 8/1959 Kreske ..... 242/597.3
3,122,113 A * 2/1964 Edwards ..... 242/128
3,342,436 A * 9/1967 Wattenford ..... 242/597.3
3,452,941 A * 7/1969 Patton ..... 242/597.3
4,063,697 A * 12/1977 Venot ..... 242/131
4,767,074 A * 8/1988 Bower ..... 242/597.3

* cited by examiner

*Primary Examiner*—Kathy Matecki
*Assistant Examiner*—Sang Kim
(74) *Attorney, Agent, or Firm*—Stephen J. Stark; Miller & Martin PLLC

(57) ABSTRACT

A tube holder on a creel receives a cardboard tube with a yam wound thereabout. The tube holder is preferably equipped with a tube stop at a non-feeding portion of the tube holder and a tube end protector which is preferably connected to the tube holder at a feeding end of the tube holder. The tube end protector is constructed at least partially out of a resilient material wherein the tube is placed over the tube end protector causing it to deflect until the cardboard tube is properly located on the tube holder wherein the tube end protector resumes its normal configuration and protects the line wound about the cardboard tube from any potential defects at the feeding end of the cardboard tube.

16 Claims, 3 Drawing Sheets

CONE HOLDER WITH TUBE END PROTECTORS

BACKGROUND OF THE INVENTION

1. Field of the Invention

This invention relates to a cone holder device with a tube end protector, and more particularly to such a device for use with creels feeding yarn to a tufting machine, warpers, heatset equipment, twisters, cabling machines, etc.

2. Description of the Related Art

Cardboard tubes are widely utilized throughout the carpet industry, and likely in other industries, to provide yarn or other materials such as string, wires, cable, etc., collectively referred to herein as "line" for further processing, such as by a tufting machine in the carpet industry. Once the material about a particular cardboard tube has been spent, the tube is often reutilized at some manufacturing locations. Over time, the cardboard tubes are kicked, dropped, squished or otherwise deformed and/or damaged to their use and abuse. The workers which utilize the cardboard tubes in the manufacture of finished goods are sometimes negligent in their inspection of the cardboard tubes. When a damaged tube is utilized, the line fed from the tube may get hung up on the tube end and break the line or disadvantageously apply tension to affect the end product.

It is common in the industry to utilize the end cap as shown in FIG. 1 on a cardboard tube to protect a damaged tube end. While this cap works with tubes which are still round, if a tube is out of round, the cap is extremely difficult, if not impossible, to put on the damaged tube. Furthermore, constant training is required of employees to ensure that they correctly and consistently put the caps on the tubes prior to directing the yarn from the cardboard tubes to the tufting machine or the like.

Accordingly, a need exists for an improved way to protect potentially damaged ends of cardboard tubes which is not subject to the inadvertent or negligent failure of some employees to fail to put the caps on damaged ends, or the need to utilize cardboard tubes which cannot have caps placed on the end due to their being squished in a somewhat elliptical shape, or otherwise.

As suggested above, there are problems with having an exposed damaged end. One problem is as yarn or other conduit is fed from the cardboard tube, the line can get snagged on the damaged end and cause breakage. A broken line usually results in downtime for the machine which is utilizing the line to provide a finished good. Furthermore, once the problem is corrected, there is a splice which connects the line back together which may result in an imperfection in the finished good thereby potentially decreasing the value of the finished good. Even a snag which pulls free may cause an excessive tension affecting the finished good. All of these issues are serious concerns for industry.

Accordingly, a need exists for an improved tube end protector.

SUMMARY OF THE INVENTION

Consequently, it is a primary object of the present invention to provide a method and apparatus for protecting a damaged end of a tube.

It is a further object of the present invention to provide a cone holder which replaces existing springs or tube holders or other devices.

It is another object of the present invention to provide a protector mechanism preventing line material from catching or breaking on rough edges, torn or nicked tubes, oblong or crushed tubes, or otherwise.

Another object of the present invention is to provide a permanent part of the creel with a protector to eliminate the need for personnel to manually install protectors on each individual tube prior to its use.

Accordingly, an existing tube holder on a creel is equipped with a tube stop which is typically located proximate to the non-feeding end of the tube holder. The feeding or free end of the tube holder is equipped with a deflectable tube end protector which is preferably connected to the end of the existing tube holder. Accordingly, a cardboard tube may be placed onto the tube holder which results in the deflection of the end protector until the cardboard tube is properly located on the tube holder between the end protector and tube stop which allows the end protector to deflect back to its normal position against the feeding end of the cardboard tube. In the normal configuration, the outer perimeter of the tube protector extends beyond the outer perimeter of the cardboard tube. Accordingly, as yarn or other material is fed from the cardboard tube, it contacts the edge of the tube protector instead of the end of the cardboard tube, therefore any imperfections at the end of the cardboard tube are no longer problematic for feeding the yarn from the cardboard tube.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
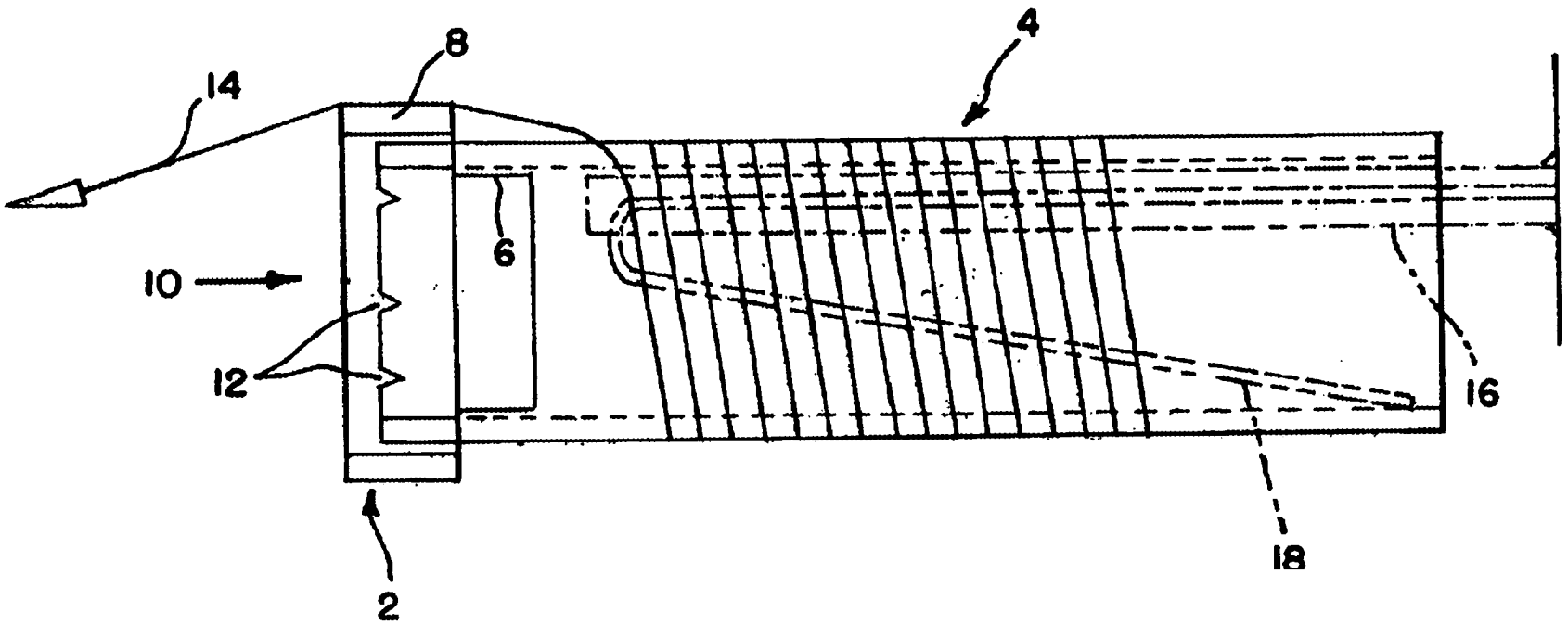
FIG. 1 PRIOR ART
FIG. 1 is a cardboard tube with line wrapped there around and an end cap as it is known in the prior art.

FIG. 1 shows a prior art cap 2 connected to a cardboard tube 4. The cap 2 is molded from plastic and is not resilient. The cap 2 has an inner flange 6 and an outer flange 8 which are spaced apart to substantially correspond to the thickness of the tube 4 so that the cap 2 may be pushed on the dispensing end 10 of the cardboard tube 4 and be connected by friction thereto. In this manner, damage illustrated by nicks 12, tears or otherwise, may be separated or spaced from the line 14 such as yarn as it is fed off the cardboard tube 4 as illustrated. As has been explained in the background of the invention, the caps 2 do not work well when the tube 4 has been partially crushed such as to create an elliptical or other non-circular shape so that the inner and outer flange 6,8 do not properly match up with the end of the cardboard tube 4 with the dispensing end 10 of the cardboard tube 4. Furthermore, a need exists so that operators are not required to manually apply the cap 2 to the tubes 4 prior to use of loaded cardboard tubes 4.

The cardboard tubes 4 are typically placed on a tube holder 16 shown in phantom and a spring 18, also shown in phantom, is typically utilized to retain the tube 4 in a desired position on a creel.

Figure 2:
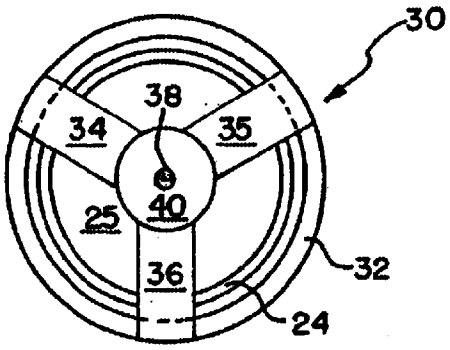
FIG. 2 is a front view of an end protection device installed on a cardboard tube according to the preferred embodiment of the present invention.
Figure 4:
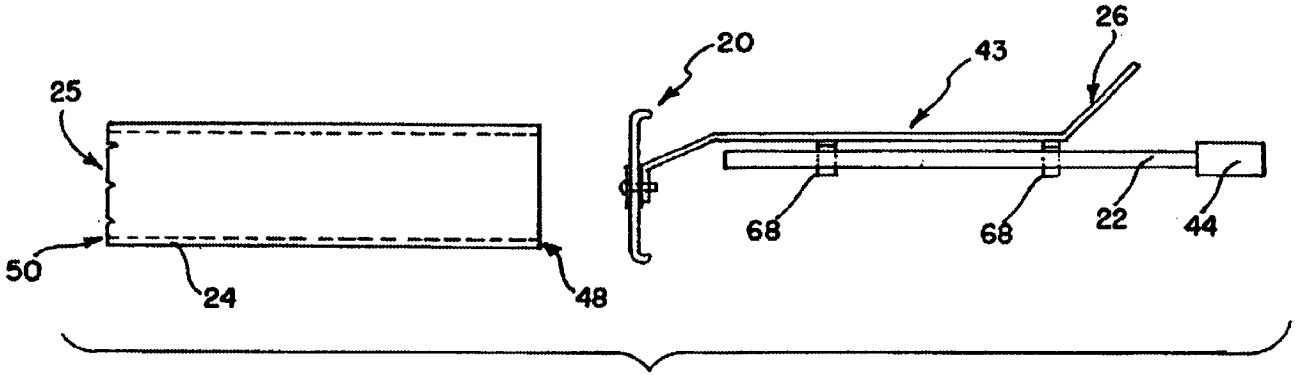
FIG. 4 is a side view of the end protection device assembly and a cardboard tube readied for positioning on the tube holder.

FIG. 2 shows a front view of the end protector 20 of the preferred embodiment of the present invention. As shown in FIGS. 2 and 4, the protector 20 along with the tube holder 22, tube 24 having an open mouth 25, and tube stop 26 comprise the preferred embodiment of the tube feed assembly 30. The tube 24 is preferably cardboard and wound with a line (as shown in the prior art of FIG. 1) which could be comprised of yarn, thread, fiber optic cable, or other string, cable, or other such material as is commonly wound about a tube 24 for storage and dispensing.

Referring back to FIG. 2, details of the end protector 20 are illustrated. The end protector 20 preferably has an outer ring 32 comprised of a resilient material such as rubber or other appropriate material. The preferred ring 32 is circular, but a substantially continuous curve or other configuration may also suffice. The outer ring 32 is connected to the tube holder 22 by one or more spokes 34,35,36. In fact, a single spoke 34 may encompass the entire interior volume interior of the outer ring 32. The preferred embodiment utilizes a plurality of spokes 34 which are also made of a resilient material such as rubber. The ring 32 is preferably spaced a distance from an exterior surface of the tube 24 as illustrated.

Figure 3:
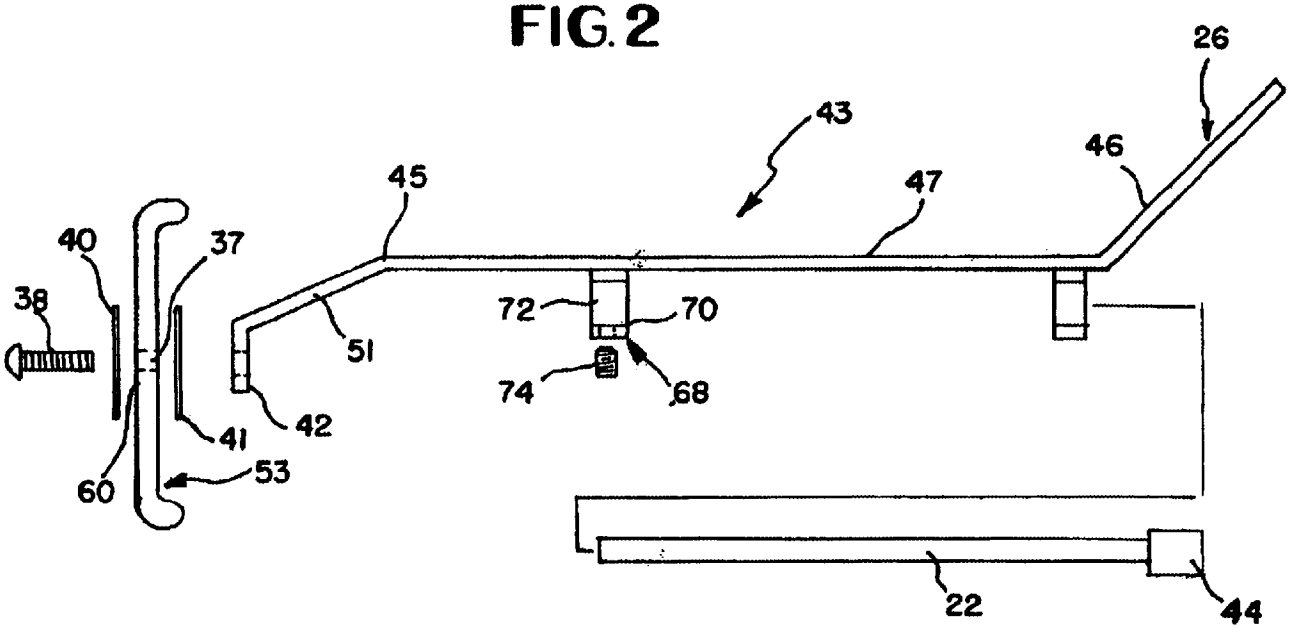
FIG. 3 is an exploded side view of the end protection device illustrated in FIG. 2.

A mount 37 is illustrated in FIG. 3 for connecting the outer ring 32 such as along one of the spokes 34 or otherwise to the tube holder 22 illustrated in FIG. 4, or a cap or frame 43 or other structure connected to the tube holder 22. A fastening screw 38 is illustrated extending through stop 40 through the mount 37 and a receiver 42. Support 41 may also be utilized. The purpose of the stop 40 will be explained in further detail below.

Figure 6:
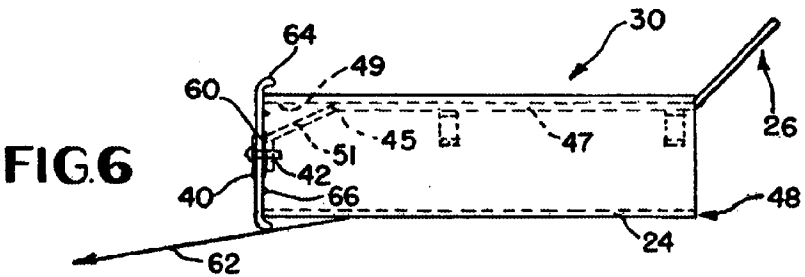
FIG. 6 shows the preferred placement of the end protection device relative to the cardboard tube in a normal configuration.

The receiver 42 is preferably located on frame 43 as shown in FIG. 3. This frame 43 connects to tube holder 22 as illustrated in FIG. 4. In other embodiments, the frame 43 may be a portion of the tube holder 22 such as integrally connected, or otherwise. Additionally, the preferred frame 43 has elbow 45 which allows for the displacement of the receiver at a distance below frame member 47 and from the tube holder 22. As illustrated in FIG. 6, frame member 47 supports an inner surface 49 of cardboard tube 24. The elbow 45 displaces leg 51 so that receiver 42 may be located approximate to a center line of the cardboard tube 24 when installed. Receiver 42 connects to leg 51 as illustrated.

In order to locate the receiver 42 with the center line of the cardboard tube 24, the distance between receiver 42 and the frame member 47 is substantially the distance from the center axis of the cardboard tube 24 to the inner surface 49, i.e., the internal radius of the cardboard tube 24. In other embodiments, the receiver 42 need not be at the center of the tube 24.

In order to connect the frame 43 to the tube holder 22, the frame 43 is equipped with connectors 68 which may include the housings 70 with bore 72 therein. After placing the frame 43 in the desired position, set screw 74 will be utilized to secure the frame 43 to the tube holder 22. In FIG. 4, the tube holder 22 is illustrated extending from creel 44.

Figure 5:
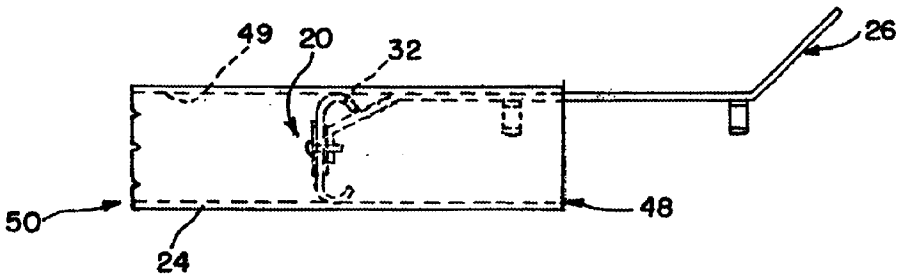
FIG. 5 is the assembly and the cardboard tube of FIG. 4 with the cardboard tube partially placed over the tube holder.

Referring back to FIGS. 2 and 3, the spokes 34,35,36 are preferably resilient so that when the tube 24 as shown in FIG. 4 is aligned along the axis of the tube holder 22, then as shown in FIG. 5, the outer ring 32 and spokes 34,35,36 deflect to allow a tube 24 to be located as shown in FIG. 6. The interior surface 49 of the tube 24 preferably is supported by the tube holder 22, such as by portions of frame member 47 of the tube holder 22 or otherwise. The tube 24 has a bore extending through at the mouth 25 which the end protector 20 passes through in a deflected configuration.

The tube stop 26 may or may not be present in all embodiments. However, when utilized, the tube stop 26 provides a slanted surface 46 which may "catch" the distal end 48 of the tube 24 and, along with gravity, direct the proximal or feeding end 50 of the tube 24 against the back side 51 of the spokes 34,35,36 and/or ring 32 or at least down on the tube stop 22 as illustrated in FIG. 6. The slanted surface 46 of the tube stop 26 is illustrated as having about a 45 degree angle relative to the tube holder 22 and may be connected with an adjustable slide to the tube holder 22 in some embodiments.

While many materials may be utilized for the spokes 34,35,36 and ring 32, rubber of various thicknesses has been found to be helpful. In fact, the reinforcement along the same spokes 35 may be found helpful to provide additional rigidity toward the certain portions of the outer ring 32 during operation. The use of materials with varying degrees of resiliency may also be utilized. Since the mount 37 is located centrally relative to tube 24 in the preferred embodiment, the rigidity of the spokes 34,35,36 may be similar.

As the tube 24 is placed over the tube holder 22 as shown in FIG. 5, the end protector 20 deflects as it passes along the inner surface 49 of the tube 24. When the outer ring 32 is deflected as shown in FIG. 5, the stop 40 may be spaced apart from the spokes 34,35,36 or a hub 60. However, when the tube 24 is in the position shown in FIG. 6, the stop 40 retains the hub 60 and spokes 34,35 from flexing in the opposite direction (i.e., the feeding direction). Of course, the stop 40 need not be utilized in all embodiments, however, it has been found helpful in the preferred embodiment illustrated.

Once the tube 24 is installed as shown in FIG. 6, line 62 such as yarn, fiber optic cable, or other wound material about the tube 24 is directed for further processing such as to a tufting machine, to a braider, or to an appropriate machine for further processing. As the line 62 is fed to the machine, as illustrated, it contacts the outer surface 64 of the outer ring 32 thereby preventing the line 62 from contacting the damaged portion 66 illustrated in FIG. 6. This design is believed to greatly reduce the number of breaks or snags of the line 62 and thus increase the efficiency of the downstream machine in production process while minimizing the number of imperfections in the finished good produced.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. A yarn feed assembly comprising:

an end protector having an outer ring and a mount thereon, said outer ring having an outer surface;

a tube holder with a feeding end, said feeding end of the tube holder connected to the mount of the end protector;

a tube having an inner bore disposed about the tube holder and a feeding end, said outer ring of said end protector extending a distance beyond the exterior surface of the tube in a normal configuration, and said outer ring deflectable to pass through the bore in a deflected configuration and then return to the normal configuration after passing the tube;

a line wrapped about the tube, said line directed toward the feeding end of the tube holder from the tube in the normal configuration, said line at least intermittently contacting at least a portion of the outer surface of the outer ring as the line is unwrapped from the tube and fed forwardly from the tube past the feeding end of the tube holder; and the outer ring of the end protector contacting the feeding end of the tube in the normal configuration.

2. The yarn feed assembly of claim 1 wherein the end protector further comprises an arm defining a spoke extending from the outer ring to a hub and the mount is located on the hub.

3. The yam feed assembly of claim 2 wherein the hub is centrally located intermediate at least two spokes.

4. The yarn feed assembly of claim 3 further comprising a stop located at the feeding end of the end protector, said stop limiting deflection of a second spoke of said at least two spokes in a direction of feeding.

5. The yarn feed assembly of claim 4 wherein the stop is operably coupled to the end protector at the mount.

6. The yarn feed assembly of claim 2 wherein the spoke is resiliently coupled to the outer ring.

7. The yarn feed assembly of claim 1 wherein the outer ring is deformable so that the tube may be passed over the end protector onto the tube holder and into a desired feeding position and said outer ring then resuming its normal non-deformed configuration.

8. The yarn feed assembly of claim 1 wherein the outer ring is resilient.

9. The yarn feed assembly of claim 1 wherein the tube further comprises a first and a second end, said second end proximate to the feeding end of the tube holder in the normal configuration, and further comprising a tube stop connected to the tube holder at a non-feeding end of the tube stop, said tube stop having an angled upper surface contacting the first end of the tube and urging the tube toward the feeding end of the tube holder.

10. A yarn feed assembly comprising:

a tube holder connected to a creel at a first end of the tube holder;

an end protector connected to the tube holder and spaced forwardly from the first end, said end protector having an outer ring resiliently coupled to the tube holder, said outer ring having an outer surface;

said outer ring of said end protector extending a distance beyond an exterior surface of the tube in a normal configuration, and said outer ring deflectable to pass through an inner bore in a deflected configuration and then return to the normal configuration after passing the tube; and the tube having said first end spaced from a feeding end, and the exterior surface which a line is wrapped around the exterior surface, said tube located around at least a portion of the tube holder, said line directed forwardly away from the first end of the tube and at least intermitently contacting at least a portion of the outer surface of the outer ring as the line is unwrapped from the tube and fed forwardly from the feeding end of the tube in the normal configuration; and the outer ring of the end protector contacting the second feeding end of the tube in the normal configuration.

11. The yarn feed assembly of claim 10 further comprising a frame having a receiver and a connector, and wherein the end protector has a mount connected to the receiver and the connector is connected to the tube holder.

12. The yarn feed assembly of claim 11 wherein the frame has an elbow located intermediate a frame member and a frame leg, and said receiver is connected to the frame leg and spaced apart from the frame member.

13. The yarn feed assembly of claim 10 wherein the end protector further comprises a hub located substantially at the center of the outer ring, and said hub having at least two spokes extending therefrom to the outer ring, and a mount located on one of the hub and the spokes.

14. The yarn feed assembly of claim 10 wherein a direction from the first end to the end protector is defined as a feeding direction, and said yarn feed assembly further comprising a stop operably coupled to the end protector, said stop substantially limiting deflection at least a portion of the end protector in the feeding direction.

15. The yarn feed assembly of claim 10 further comprising a tube stop located intermediate the first end and end protector of the tube holder.

16. The yarn feed assembly of claim 10 wherein the end protector further comprises at least a first and a second spoke and the mouth of the tube contacts at least one of the first and second spokes.

* * * * *